US005188147A

United States Patent [19]

Shirai et al.

[11] Patent Number: 5,188,147

[45] Date of Patent: Feb. 23, 1993

[54] PRESSURE COMPENSATING TYPE HYDRAULIC VALVE

[75] Inventors: Kiyoshi Shirai; Kazuo Uehara; Koichi Morita; Takahide Takiguchi; Naoki Ishizaki, all of Kawasaki, Japan

[73] Assignee: Kabushiki Kaisha Komatsu Seisakusho, Tokyo, Japan

[21] Appl. No.: 611,499

[22] Filed: Nov. 13, 1990

[51] Int. Cl.[5] ..... F15B 13/08

[52] U.S. Cl. ..... 137/596; 60/427; 60/452; 91/446; 137/596.13

[58] Field of Search ..... 60/427, 452; 91/446; 137/596, 596.13

[56] References Cited

U.S. PATENT DOCUMENTS

| | | | |
|---|---|---|---|
| 3,602,104 | 8/1971 | Stremple | 137/596.13 X |
| 4,253,482 | 3/1981 | Stephens | 137/596.13 X |
| 4,693,272 | 9/1987 | Wilke | 137/596 |
| 4,782,859 | 11/1988 | Constantinian | 137/596.13 X |
| 5,025,625 | 6/1991 | Morikawa | 137/596.13 |

FOREIGN PATENT DOCUMENTS

| | | | |
|---|---|---|---|
| 59-34006 | 2/1984 | Japan | 137/596.13 |

*Primary Examiner*—Gerald A. Michalsky
*Attorney, Agent, or Firm*—Vorys, Sater, Seymour & Pease

[57] ABSTRACT

A pressure compensating type hydraulic valve wherein a pressure compensation can be made according to the movement of the movable portion of a hydraulic actuator, and the movable portion of the actuator can be stopped against load pressure when it is located at its neutral position. This pressure compensating type hydraulic valve is arranged such that a spool (24) is moved in a valve hole (16) so as to allow a first actuating port (21) and a second actuating port (22) connected with pressure receiving chambers ($13_1$, $13_2$), respectively, defined on both sides of a movable portion ($13_3$) of a hydraulic actuator (13) to be selectively connected with or disconnected from a first pumping port and a second pumping port in which fluid under pressure discharged by a hydraulic pump (10) flows, through the intermediary of a first check valve (31) and a second check valve (32), respectively, both of which are preset at predetermined pressures, and either one of the actuating ports which is isolated from the pumping port is connected with either one of the tank ports ($33_1$, $33_2$).

2 Claims, 6 Drawing Sheets

PRESSURE COMPENSATING TYPE HYDRAULIC VALVE

TECHNICAL FIELD OF THE INVENTION

This invention relates to a pressure compensating type hydraulic valve for use in hydraulic circuits for supplying fluid under pressure into a plurality of hydraulic actuators such as boom cylinders and arm cylinders, etc. mounted on heavy construction equipment such as power shovels, etc.

BACKGROUND ART OF THE INVENTION

There are heretofore known power shovels provided with a plurality of hydraulic actuators such as a boom cylinder, an arm cylinder, a bucket cylinder, a running motor and a turning motor, etc., and hydraulic circuit for supplying fluid under pressure into these hydraulic actuators, which includes a plurality of valves connected to discharge passages of a hydraulic pump, the arrangement being made such that fluid under pressure may be supplied by changing over each of the valves into each of the hydraulic actuators.

However, when the plurality of valves are operated simultaneously, fluid under pressure is supplied into hydraulic actuators whose load pressures are low, whilst fluid under pressure is not supplied into hydraulic actuators whose load pressures are high.

To eliminate such difficulties, there is provided a hydraulic circuit provided with a plurality of pressure compensating hydraulic valves which can be operated at the same time so as to supply or distribute fluid under pressure into each hydraulic actuator at a uniform flow rate, as disclosed in Japanese Laid-Open Patent Application NO. SHO 60-188604.

The pressure compensating type hydraulic valve disclosed in the above-mentioned Japanese Patent Applications specification is constructed such that, as shown in FIG. 6, a spool 2 is slidably mounted in a valve body 1 so as to allow inlet ports 3 and 4 to be selectively connected with and disconnected from actuating ports 5 and 6, respectively, and a bridging passage 7 formed in the valve body 1 is arranged to be selectively connected with and disconnected from the actuating ports 5 and 6, respectively, and provided with a pressure compensating type hydraulic valve adapted to be set by a maximum working pressure in a plurality of hydraulic actuators, the arrangement being made such that fluid under pressure may be supplied into the actuating ports 5, 6 in the plurality of pressure compensating type hydraulic valves thereby ensuring supply of fluid under pressure into each hydraulic actuator at a uniform flow rate even in case a plurality of hydraulic actuators are operated simultaneously and their load pressures are different.

In such a pressure compensating type hydraulic valve, since the pressure in the first and second actuating ports 5 and 6 is set by one and the same pressure compensating valve, the pressure compensation characteristic obtainable when fluid pressure is supplied into the first actuating port 5 becomes the same as that obtainable when fluid pressure is supplied into the second actuating port 6. As a result, in case the spool 2 is moved by the same stroke in opposite directions, fluid under pressure is supplied at the same flow rate into either one of the actuating ports 5 and 6. Therefore, to supply fluid under pressure into the ports 5 and 6, respectively, at different flow rates, the area of opening in each port must be decided by regulating the stroke of the spool 2 depending on the flow rate of fluid required by the hydraulic actuator, and so the operation itself becomes troublesome. Thus, in case a large number of hydraulic actuators are operated simultaneously, regulation needs to be made at a position where a big change occurs in the maximum area of opening of the spool.

Further, since the load pressure is introduced into the pressure compensating type hydraulic valve by allowing the first and second actuating ports 5 and 6 to be connected with or disconnected from the bridging passage 7 by land portions 2*a*, 2*a* of the spool 2 when the spool is held at its neutral position, there is a tendency of fluid under pressure leaking from either the actuating port 5 or the actuating port 6 through either one of the land portions 2*a*, 2*a* and the bridging passage 7 into the fluid reservoir or tank, thus rendering it impossible to stop the movable component of the hydraulic actuator against the load pressure.

SUMMARY OF THE INVENTION

The present invention has been made in view of the above-mentioned circumstances, and has for its object to provide a pressure compensating type hydraulic valve wherein pressure compensation can be made according to the movement of the movable portion of a hydraulic actuator, and when its spool is located at its neutral position the movable portion of the hydraulic actuator can be stopped against the load pressure.

To achieve the above-mentioned object, according to a first aspect of the present invention, there is provided a pressure compensating type hydraulic valve provided in a hydraulic circuit for selectively supplying fluid under pressure discharged by a hydraulic pump into either one of pressure receiving chambers defined on both sides of a hydraulic actuator and draining the fluid within the other pressure receiving chamber, the hydraulic valve comprising: a spool slidably mounted in a valve hole formed in the valve body so as to selectively supply fluid under pressure discharged by the hydraulic pump into either one of a first actuating port and a second actuating port connected with the pressure receiving chambers, respectively, and selectively connect the other actuating port with a fluid tank; a pair of left-hand and right-hand first and second pumping ports formed between the spool and the valve hole and which are connected with a discharge passage of the hydraulic pump; a pair of left-hand and right-hand first and second outlet ports formed in the valve hole and arranged to be connected with or disconnected from these pumping ports through the intermediary of the spool; a pair of left-hand and right-hand first and second check valves mounted in the valve body so as to control connection or disconnection of these outlet ports with or from the first and second actuating ports, respectively; and a load pressure sensing port formed in the valve hole at a position substantially corresponding to the central portion of the spool when it is located at its neutral position, and arranged to communicate through a shuttle valve with the back pressure chambers of the first and second check valves, respectively, characterized in that movement of the spool is controlled so as to allow either one of the first and second actuating ports to be selectively connected with or disconnected from the load pressure sensing port through the intermediary of a pair of left-hand and right-hand central holes formed in the spool so as to extend axially and substantially along the center line thereof and a plurality of drilled holes formed at predetermined intervals along the spool so as to extend from the outer peripheral surface thereof to the central holes.

According to the pressure compensating type hydraulic valve according to the present invention incorporating the above-mentioned aspect, since the pressure in the first actuating port is preset by the first check valve and the pressure in the second actuating port is preset by the second check valve, the pressure in the first actuating port can be made different from that in the second actuating port by setting the first and second check valves at different pressures so that the pressure compensation characteristic of the hydraulic actuator when moving in one direction may be changed from that when moving in the other direction, according to the movement of the actuator.

Further, since the pressures in the first and second actuating ports are introduced through the intermediary of the drilled holes formed in the spool into the back pressure chambers of the first and second check valves, respectively, the possibility of leakage of fluid under pressure in the first and second actuating ports to the fluid tank at the neutral position can be reduced so that the movable portion of the hydraulic actuator can be held against the load pressure.

The above-mentioned and other objects, aspects and advantages of the present invention will become apparent to those skilled in the art by making reference to the following description and the accompanying drawings in which a preferred embodiment incorporating the principles of the present invention is shown by way of example only.

DETAILED DESCRIPTION OF PREFERRED EMBODIMENTS

The present invention will now be described by way of example only with reference to the accompanying drawings.

Figure 2:
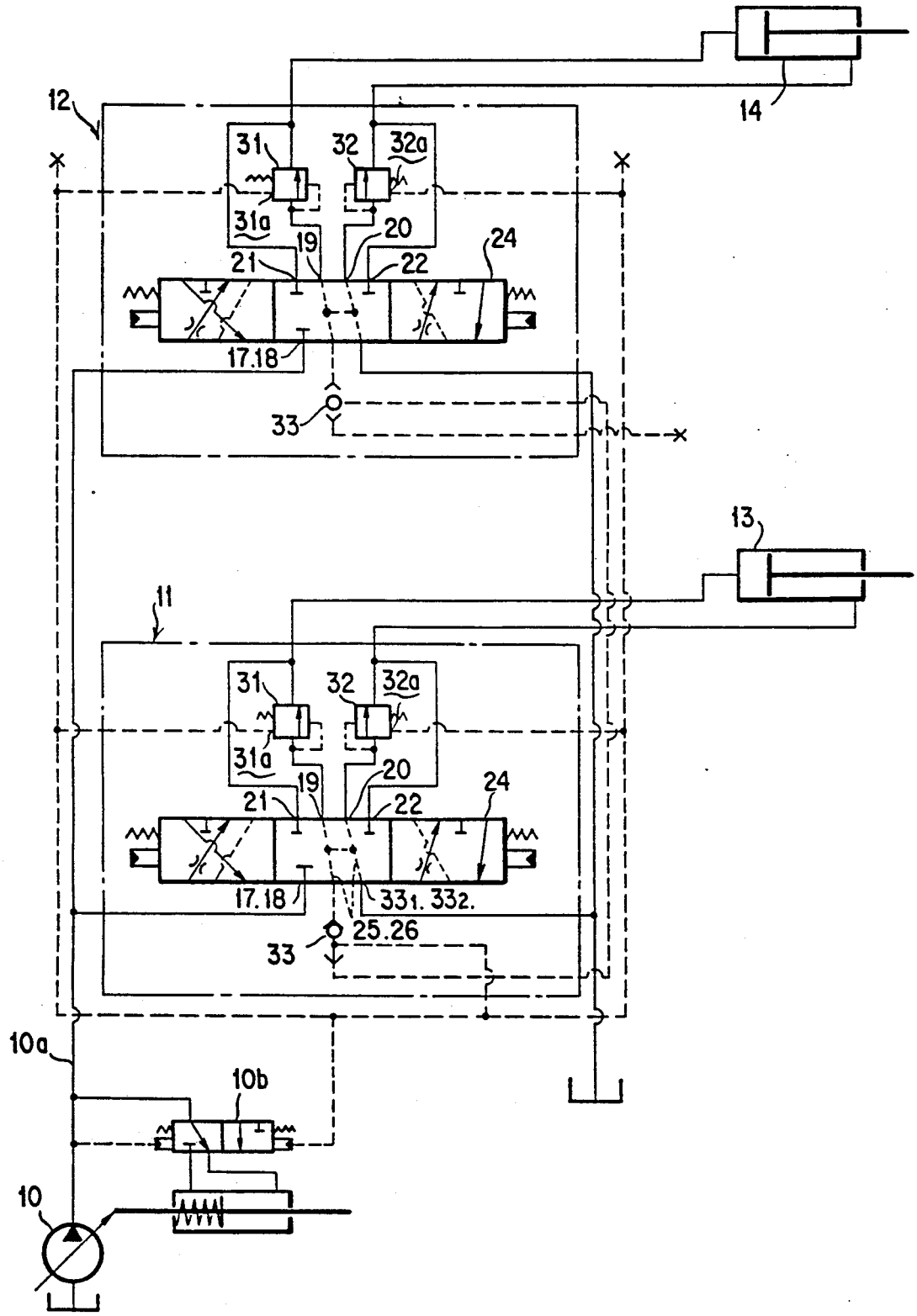
FIG. 2 is a hydraulic circuit diagram using the embodiment of the present invention.

FIG. 2 is a hydraulic circuit diagram. A hydraulic pump 10 has a delivery passage 10*a*, to which first and second pressure compensating type hydraulic valves 11 and 12 are connected so that they may supply fluid under pressure into first and second hydraulic actuators 13 and 14, respectively.

Figure 1:
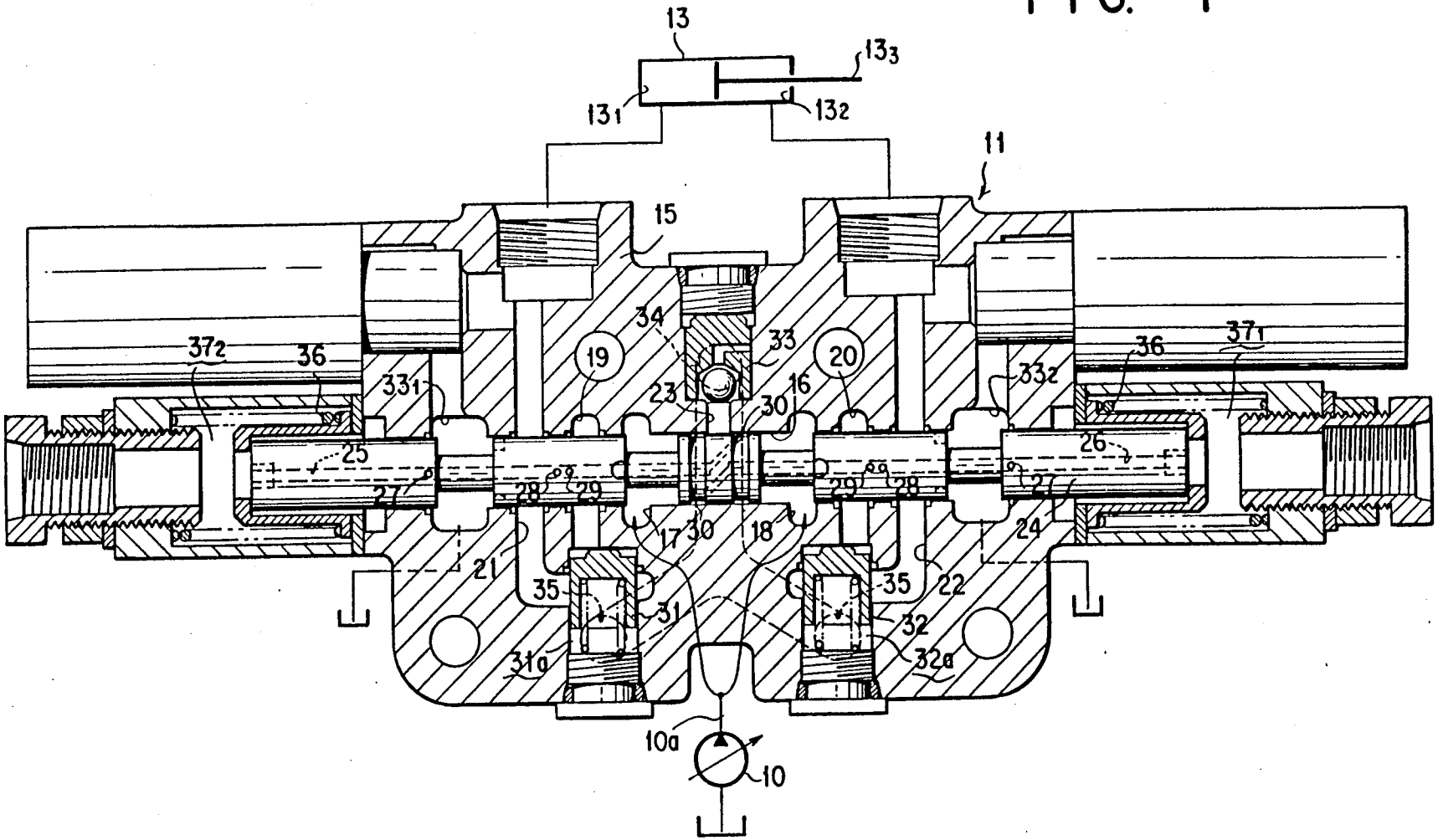
FIG. 1 is a schematic sectional view showing one embodiment of the present invention.

As shown in FIG. 1, the above-mentioned first pressure compensating type hydraulic valve 11 has a valve body 15 having a valve hole 16 formed therein.

The valve hole 16 has formed therein first and second pumping ports 17, 18, first and second outlet ports 19, 20, first and second actuating ports 21, 22, a load pressure sensing port 23, and first and second tank ports $33_1$, $33_2$, connection and disconnection of these ports being controlled by a spool 24.

The above-mentioned spool 24 has first and axially extending central holes 25 and 26 formed therein and which open on the outer peripheral surface thereof through first, second third and fourth drilled holes 27, 28, 29 and 30. The first outlet port 19 is allowed to communicate with the second actuating port 21 by the action of a first check valve 31, whilst the second outlet port 20 is allowed to communicate with the second actuating port 22 by the action of a second check valve 32. The abovementioned load pressure sensing port 23 is connected with or disconnected from a port 34 by way of a shuttle valve 33, and the port 34 communicates through each of ports 35 with back pressure chambers 31*a* and 32*a* formed in first and second check valves 31 and 32, respectively.

The above-mentioned first and second pumping ports 17 and 18 are connected to the delivery passage 10*a* of the hydraulic pump 10, whilst the first and second actuating ports 21 and 22 are connected with first and second chambers $13_1$ and $13_2$, respectively, of the first hydraulic actuator 13.

The above-mentioned spool 24 is held at its neutral position by the resiliency of a pair of springs 36, 36, as shown in FIG. 1, so as to close the ports. In this condition, the first drilled holes 27, 27 are allowed to communicate with the first and second tank ports $33_1$ and $33_2$, respectively, and the third drilled holes 29, 29 are allowed to communicate with the first and second outlet ports 19 and 20, respectively, so that the upstream side of the first and second central holes 25 and 26 and the first and second check valves 31 and 32 is connected to the side of a fluid tank or reservoir.

The second pressure compensating type hydraulic valve 12 is identical in construction to the first pressure compensating type hydraulic valve 11, and its shuttle valve 33 is connected to the shuttle valve 33 of the latter. Further, a load pressure is supplied into a displacement controlling member 10*b* of the hydraulic pump 10 so that the fluid pressure discharged by the hyraulic pump 10 is controlled at a value slightly higher than the preset pressure for the check valves, which will be mentioned later.

In the next place, the operation of this embodiment will be described below.

Figure 3:
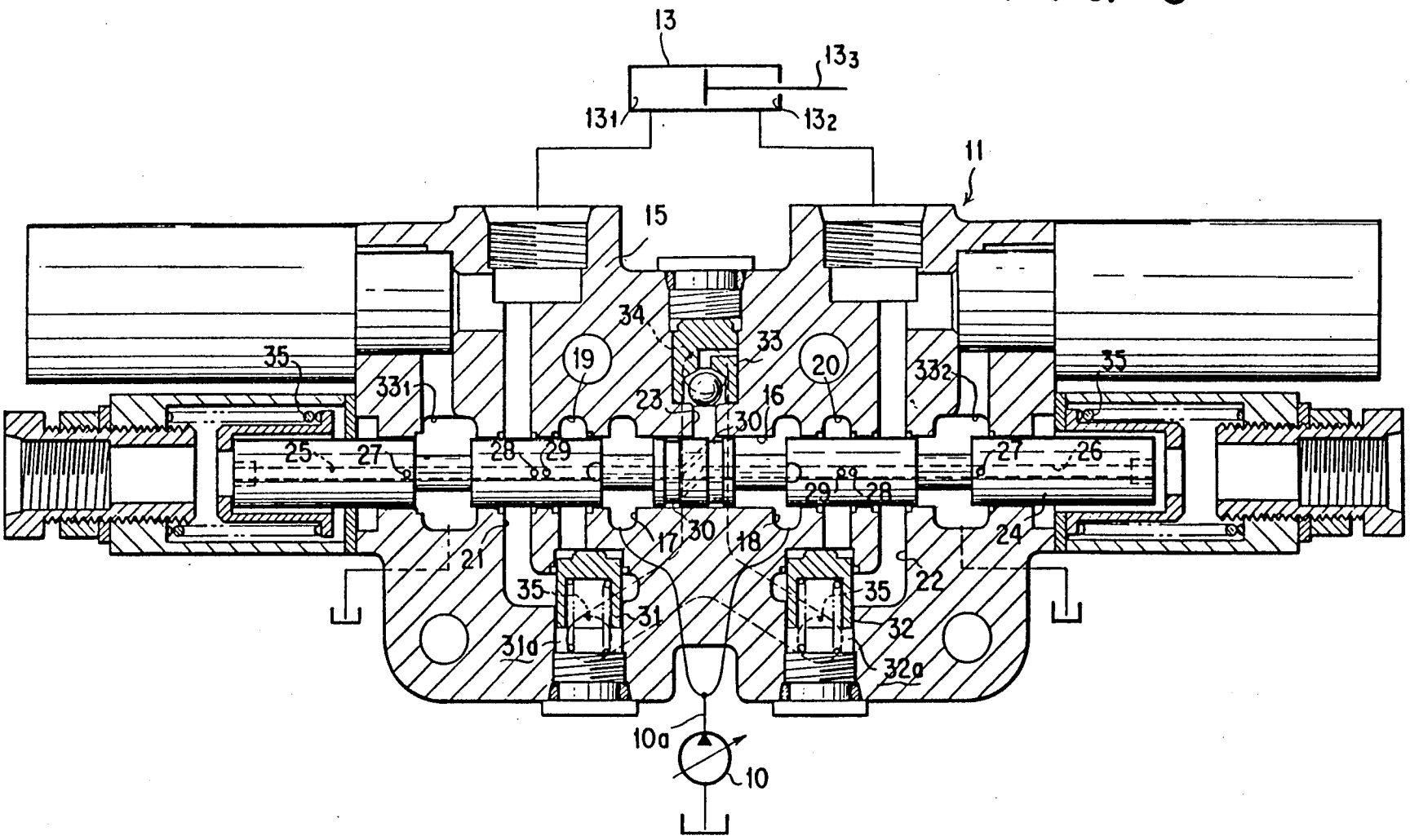
FIGS. 3 and 4 are schematic sectional views for explaining the operation of the embodiment shown in FIG. 1.

When a first pressure chamber $37_1$ is supplied with a pilot fluid pressure to move the spool 24 from the state shown in FIG. 1 to the left as shown in FIG. 3, the first drilled hole 27 and the third drilled hole 29 formed on the left-hand side of the spool 24 are closed and also the second drilled hole 28 is allowed to communicate with the first actuating port 21 and the fourth drilled hole 30 of the left hand first central hole 25 is allowed to communicate with the load pressure sensing port 23. As a result, the fluid under pressure (load pressure) is supplied through the first central hole 25 into the shuttle valve 33. In short, a load sensing circuit is formed by the first central hole 25, and the first, second, third and fourth drilled holes 27, 28, 29 and 30.

When the first and second pressure compensating type hydraulic valves 11 and 12 are rendered operative at the same time to compare their load sensed pressures, the higher load pressure is introduced through one of the ports 35 into the back pressure chamber 31*a* of the first check valve 31 so as to determine the preset pressure.

Figure 4:
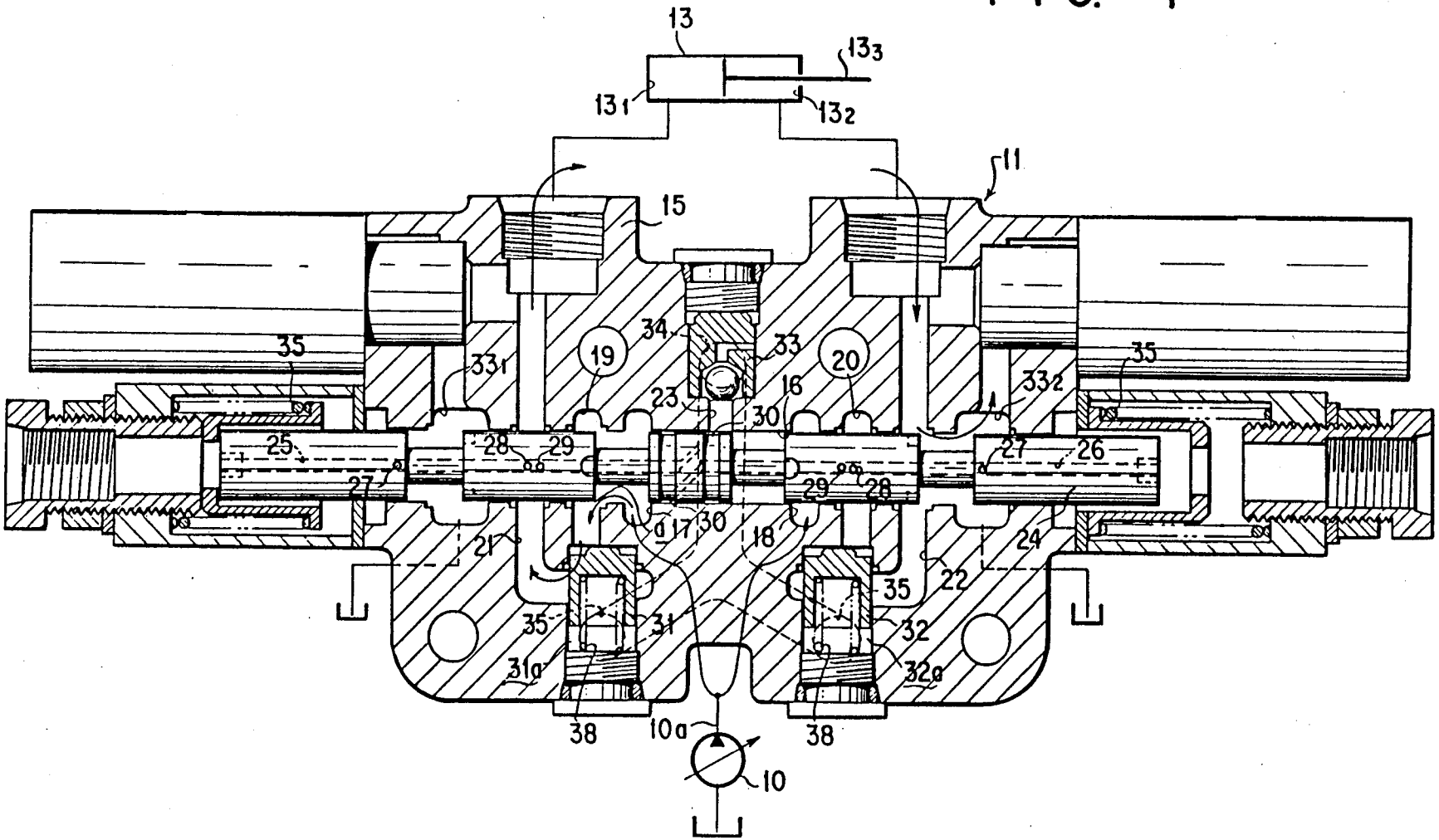

When the spool 24 is moved further to the left from the aforementioned state as shown in FIG. 4, the first pumping port 17 is allowed to communicate with the first outlet port 19, whilst the second actuating port 22 is allowed to communicate with the second tank port 34. As a result, the fluid under pressure discharged by the hydraulic pump 10 will flow through the first pumping port 17, a meter-in restrictor portion "a" and into the first inlet port 19, thus depressing the first check valve 31, and flow through the latter and the first actuating port 21 into the first chamber $13_1$ of the first hydraulic actuator 11. On the other hand, the fluid under pressure in the second chamber $13_2$ will flow through the second actuating port 22 and the second tank port $33_2$ into the tank. As a result, movable portion $13_3$ of the first hydraulic actuator 13 is moved to the right.

At that time, the fluid pressure in the first actuating port 21 will become the value preset by the first check valve 31 so that a pressure compensation is made by this preset pressure.

Further, when the second pressure receiving chamber $37_2$ is supplied with a pilot fluid under pressure to move the spool 24 to the right, similar operation to the aforementioned is made. In this case, the movable portion $13_3$ of the first hydraulic actuator 13 is moved to the left, and the fluid pressure in the second actuating port will become the value preset by the second check valve 32 so that a pressure compensation is made by this preset pressure.

Further, since the pressure preset by each of the first and second check valves 31 and 32 can be set at will by the loading of a spring 38, it is possible to make the pressure compensation characteristic of the first hydraulic actuator 13 during its movement to the right different from that during its movement to the left.

Further, since the pressure in the first and second actuating ports 21 and 22 are introduced through the small drilled holes, into the back pressure chambers of the first and second check valves, leakage of the fluid when the spool is located at its neutral position is reduced so that the movable portion $13_3$ of the first hydraulic actuator 13 can be held at a predetermined position against the load pressure.

Figure 5:
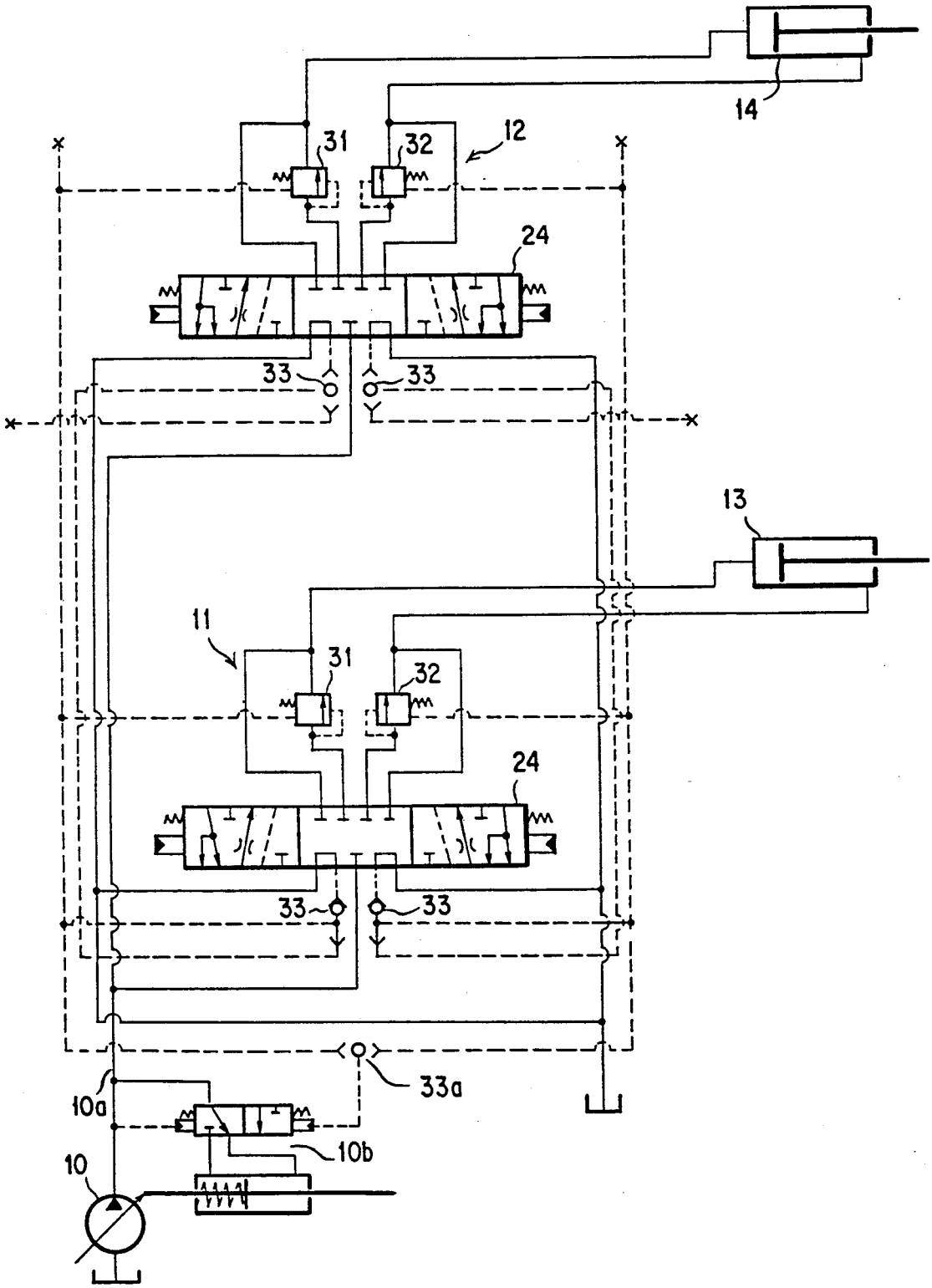
FIG. 5 shows a modification of the hydraulic circuit using the embodiment of the present invention.
Figure 6:
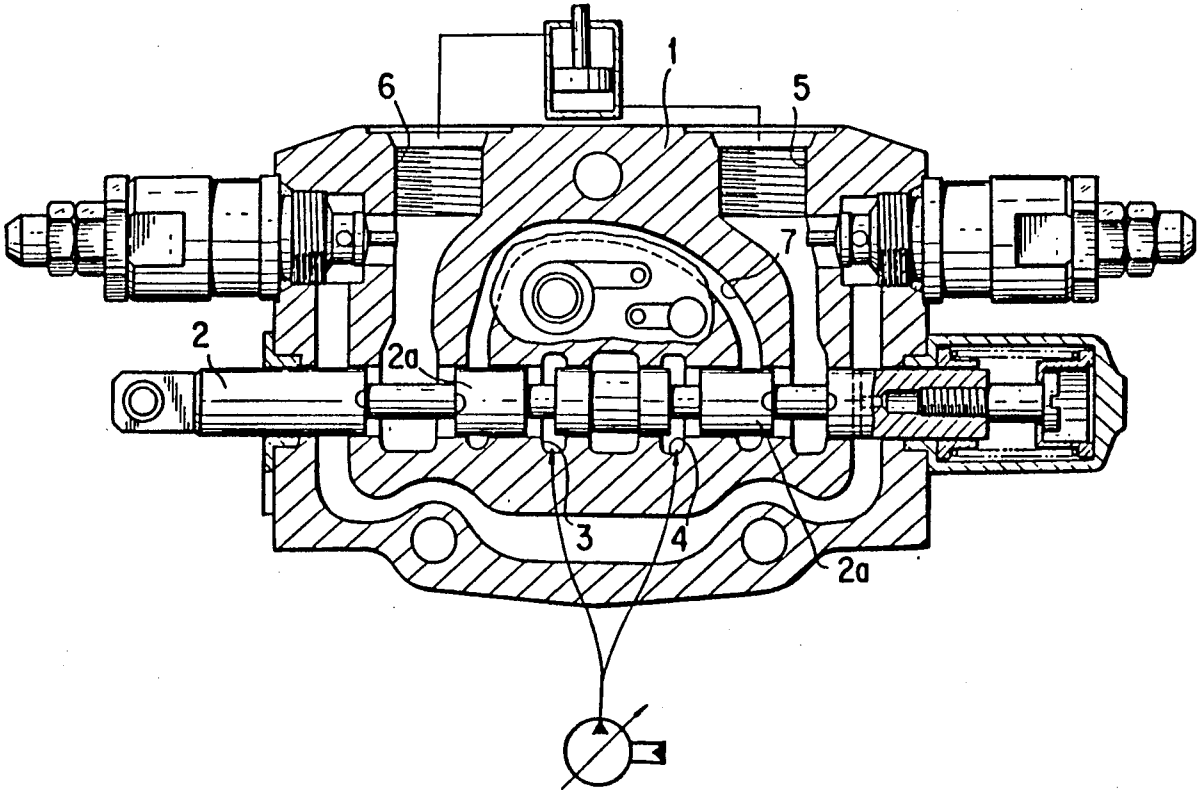
FIG. 6 PRIOR ART
FIG. 6 is a schematic sectional view of a prior art example.

Further, as shown in FIG. 5, each of the first and second pressure compensating type hydraulic valves 11 and 12 may be provided with a pair of shuttle valves 33, and also the load pressure sensed by the hydraulic valves 11 and 12 may be introduced by an auxiliary shuttle valve 33*a* into a displacement controlling member 10*b* of the hydraulic pump 10.

We claim:

1. A pressure compensating type hydraulic valve provided in a hydraulic circuit for selectively supplying fluid under pressure discharged by a hydraulic pump into either one of pressure receiving chambers defined on both sides of a hydraulic actuator and draining the fluid within the other pressure receiving chamber, the hydraulic valve comprising: a spool slidably mounted in a valve hole formed in the valve body so as to selectively supply fluid under pressure discharged by the hydraulic pump into either one of a first actuating port and a second actuating port connected with said pressure receiving chambers, respectively, and selectively connect the other actuating port with a fluid tank; a pair of left-hand and right-hand first and second pumping ports formed between the spool and said valve hole and which are connected with a discharge passage of the hydraulic pump; a pair of left-hand and right-hand first and second outlet ports formed in the valve hole and arranged to be connected with or disconnected from these pumping ports through the intermediary of said spool; a pair of left-hand and right-hand first and second check valves mounted in the valve body so as to control connection or disconnection of these outlet ports with or from said first and second actuating ports, respectively; and a load pressure sensing port formed in said valve hole at a position substantially corresponding to the central portion of said spool when it is located at its neutral position, and arranged to communicate through a shuttle valve with back pressure chambers of said first and second check valves, respectively, characterized in that movement of said spool is controlled so as to allow either one of said first and second actuating ports to be selectively connected with or disconnected from said load pressure sensing port through the intermediary of a pair of left-hand and right-hand central holes formed in the spool so as to extend axially and substantially along the center line thereof and a plurality of drilled holes formed at predetermined intervals along the spool so as to extend from the outer peripheral surface thereof to the central holes.

2. A pressure compensating type hydraulic valve as claimed in claim 1, characterized in that said valve body and said spool are symmetrically constructed on the left and right sides relative to the center line when the spool is located at its neutral position.

* * * * *